US006625519B2

(12) United States Patent
Goodwin et al.

(10) Patent No.: US 6,625,519 B2
(45) Date of Patent: Sep. 23, 2003

(54) PUMP CONTROLLER FOR SUBMERSIBLE TURBINE PUMPS

(75) Inventors: Brian Goodwin, Colona, IL (US); Jeff Caparoon, Olathe, KS (US)

(73) Assignee: Veeder-Root Company Inc., Simsbury, CT (US)

( * ) Notice: Subject to any disclaimer, the term of this patent is extended or adjusted under 35 U.S.C. 154(b) by 0 days.

(21) Appl. No.: 09/965,819

(22) Filed: Oct. 1, 2001

(65) Prior Publication Data

US 2003/0065425 A1 Apr. 3, 2003

(51) Int. Cl.[7] ..... G05D 11/00

(52) U.S. Cl. ..... 700/282; 700/283; 700/19; 417/2

(58) Field of Search ..... 700/282, 241, 700/283, 10, 19; 417/33, 2; 702/60; 222/14

(56) References Cited

U.S. PATENT DOCUMENTS

| | | | | |
|---|---|---|---|---|
| 4,247,899 A | | 1/1981 | Schiller et al. | 364/465 |
| 4,250,550 A | | 2/1981 | Fleischer | 364/465 |
| 4,432,064 A | | 2/1984 | Barker et al. | 364/550 |
| 4,442,953 A | | 4/1984 | Miyamoto et al. | 222/14 |
| 4,467,260 A | | 8/1984 | Mallick, Jr. et al. | 318/800 |
| 4,542,836 A | | 9/1985 | Sparks et al. | 222/27 |
| 4,572,405 A | | 2/1986 | Miura | 222/14 |
| 4,719,532 A | | 1/1988 | Schneider | 361/189 |
| 4,805,118 A | | 2/1989 | Rishel | 364/510 |
| 4,841,404 A | * | 6/1989 | Marshall et al. | 318/455 |
| 4,850,805 A | | 7/1989 | Madsen et al. | 417/18 |
| 4,885,655 A | * | 12/1989 | Springer et al. | 318/789 |
| 4,930,665 A | | 6/1990 | Devine | 222/28 |
| 4,939,730 A | | 7/1990 | Tarver | 371/11.2 |
| 5,015,151 A | | 5/1991 | Snyder, Jr. et al. | 417/18 |
| 5,029,100 A | | 7/1991 | Young et al. | 364/479 |
| 5,042,290 A | | 8/1991 | Geisinger | 73/40.5 R |
| 5,056,036 A | | 10/1991 | Van Bork | 364/510 |
| 5,103,410 A | | 4/1992 | Slocum et al. | 364/558 |
| 5,249,129 A | | 9/1993 | Lamoureux et al. | 364/479 |
| 5,299,135 A | | 3/1994 | Lieto et al. | 364/479 |
| 5,325,706 A | | 7/1994 | Grose | 73/40.5 R |
| 5,349,852 A | | 9/1994 | Kamen et al. | 73/149 |
| 5,361,216 A | | 11/1994 | Warn et al. | 364/510 |
| 5,363,093 A | | 11/1994 | Williams et al. | 340/605 |
| 5,375,454 A | | 12/1994 | Andrejasich et al. | 73/40.5 R |
| 5,384,714 A | | 1/1995 | Kidd | 364/550 |
| 5,385,056 A | | 1/1995 | Marsh et al. | 73/861 |

(List continued on next page.)

*Primary Examiner*—Leo Picard
*Assistant Examiner*—Alexander Kosowski
(74) *Attorney, Agent, or Firm*—Withrow & Terranova PLLC

(57) ABSTRACT

A method and apparatus for detecting the dry-run operation of a submersible fuel pump operating in a network of fuel pumps is disclosed in which the pump controller is able to switch itself off upon detection of a dry-run condition. After shutting itself off, the pump controller can request assistance from another pump in the pump network. When fuel is added to the tank, the fuel pump controller will detect the presence of the fuel and reactivate the pump.

18 Claims, 2 Drawing Sheets

U.S. PATENT DOCUMENTS 5,417,649 A 5/1995 Kawahara et al. ..... 604/4
5,612,629 A 3/1997 Mullin et al. ..... 324/772
5,612,890 A 3/1997 Strasser et al. ..... 364/479.11
5,630,528 A 5/1997 Nanaji ..... 222/1
5,652,525 A 7/1997 Mullin et al. ..... 324/772
5,654,885 A 8/1997 Mayhew et al. ..... 364/181
5,673,732 A 10/1997 Kenney et al. ..... 141/59
5,687,092 A 11/1997 Bretmersky et al. ..... 364/510
5,706,273 A 1/1998 Guerreri ..... 364/510
5,735,435 A 4/1998 Kobayashi et al. ..... 222/63
5,742,500 A 4/1998 Irvin ..... 364/138
5,757,664 A 5/1998 Rogers et al. ..... 364/509
5,769,134 A 6/1998 Kenney et al. ..... 141/59
5,771,178 A 6/1998 Stemporzewski, Jr. et al. ..... 364/510
5,794,667 A 8/1998 Payne et al. ..... 141/128
5,874,787 A 2/1999 Meyer et al. ..... 307/39
5,905,867 A * 5/1999 Giorgio ..... 709/224
5,926,097 A 7/1999 Kobayashi et al. ..... 340/618
5,930,092 A * 7/1999 Nystrom ..... 361/30
5,934,508 A 8/1999 Kenney et al. ..... 222/55
5,954,089 A 9/1999 Seymour ..... 137/487.5
5,959,547 A * 9/1999 Tubel et al. ..... 340/853.2
5,966,311 A 10/1999 Stemporzewski, Jr. et al. ..... 364/528.16
5,996,843 A 12/1999 Hough ..... 222/71
6,011,368 A 1/2000 Kalpathi et al. ..... 318/434
6,036,053 A 3/2000 Simmons et al. ..... 222/1
6,070,760 A 6/2000 Kenney et al. ..... 222/55
6,144,924 A * 11/2000 Dowling et al. ..... 702/60
6,178,393 B1 * 1/2001 Irvin ..... 700/282
6,254,353 B1 * 7/2001 Polo et al. ..... 417/44.11
6,481,973 B1 * 11/2002 Struthers ..... 417/36

* cited by examiner

PUMP CONTROLLER FOR SUBMERSIBLE TURBINE PUMPS

BACKGROUND OF THE INVENTION

FIELD OF THE INVENTION

This invention relates generally to the field of submersible fuel pumps for use in underground fuel storage tanks. More specifically, this invention relates to pump controllers and networks of fuel pumps used in conjunction with submersible fuel pumps to dispense fuel at service stations.

Most neighborhood gas stations provide a number of fuel pumps each capable of dispensing a variety of fuel grades. But while the gas station may have several fuel dispensers, these stations typically store fuel in only a few underground tanks. Most often the gas station will have only a few tanks for each fuel grade, and these few tanks will provide the fuel for that particular grade to all of the dispensers at the gas station that are capable of dispensing that grade of fuel.

Because only a few fuel tanks are providing the fuel for a number of dispensers, the pumps which actually draw the fuel out of the tanks are submerged within the fuel in the fuel tank itself. By placing the pumps inside the fuel tank, the overall number of pumps that have to be maintained is reduced. Furthermore, submersing the pump in the fluid itself allows the fuel to cool the pump motor. This allows for the use of higher capacity motors and pumps without requiring additional cooling systems.

Placing the pump inside the fuel tank has a number of drawbacks, however. Because the tanks are typically located under the pavement of the station, they are not readily accessible for maintenance or monitoring. Furthermore, submersing the pumps in the fuel requires that extra care be taken to prevent electrical malfunctions which could cause sparks or which could cause the pump motor to overheat, either of which may ignite the fuel or damage the pump motor.

Among the problems encountered most often with submersible pumps is that of dry-run operation. In this situation, the fuel level in the tank has fallen below the pump motor causing the pump motor to operate in the air. Because the cooling for submersible pumps is provided by the fuel itself, operating in the air can cause the motor to overheat. In addition, submersible pump motors are designed to provide optimum performance when they are pumping and operating in fuel, so prolonged dry-run operation can damage the pump motor.

To address these issues, most submersible pumps include pump controllers that monitor the operation of the pump. Conventional controllers provide monitoring for such operational characteristics as fluid leaks, pump failure, and pump and conduit pressure. These conventional controllers often require the use of sensors to provide the data for the monitored condition. While using sensors inside the pumps to monitor malfunctions can be cost-effective and allow for the monitoring of a wide variety of pumping factors, the life span or durability of these sensors is often far shorter than that of the pump itself. Furthermore, as more sensors are added to the pump to monitor possible malfunctions, the computer equipment required to process the information and relay it to the operator becomes more sophisticated. Finally, these conventional controllers require the operator to manually reset them after each malfunction has been corrected. This lengthens the time the pump is taken off-line as a result of a malfunction, and complicates the repair process for the operator and fuel station owner.

What is needed in the industry is a robust pump controller capable of detecting malfunctions and errors that arise during operation, but which does not use fragile sensor equipment and which can reset itself upon correction of the underlying malfunction.

SUMMARY OF THE INVENTION

The present invention addresses the above-mentioned problems associated with conventional pump controllers by providing a method of detecting faults in the fuel pumping process without the use of specialized sensors. In addition, pump controllers in accordance with the present invention can be networked or disposed together in a manifold to allow a number of pumps to work simultaneously or in turn in a single tank or across multiple tanks supplying the same fuel grade. This provides for pump redundancy in the event of pump failure or parallel operation in order to minimize extended use of any single pump or to supply large quantities of fuel to the dispensers during period of high demand.

Specifically, the present invention deals with the problem of dry-run operation by automatically shutting off the pump and signaling a dry-run alarm when the dry-run condition is detected. When new fuel is added to the tank, the controller is capable of detecting this condition and automatically resetting itself without user intervention.

In order to accomplish this automatic shutoff and automatic reset, the controller must be calibrated when it is installed. During the calibration, the pump motor is started, but no fuel is dispensed. A microprocessor in the controller samples the voltage, current, and phase between the voltage and current signals of the pump motor and stores these as the reference values. These values are compared against values measured during normal operation of the motor to detect the presence of faults.

Specifically, the phase value between the voltage and current signals of the motor is used to measure the power factor of the electrical motor. The power factor of the motor represents a ratio between the energy into the motor and the energy coming out of the motor. If the power factor is low, the motor is only putting out a fraction of the power put into it. When the power factor is low, the phase value will be high. Because the reference value for the phase is determined when the pump motor is operated in the presence of fuel, the phase value will only be higher than this reference value if the pump is operating in the absence of fuel. If this is the case, the controller will shut off the pump motor and signal the dry run condition alarm. An operator, human or otherwise, seeing this alarm will recognize that the fuel tank is low or empty.

Every time the fuel dispenser is activated, the controller momentarily reactivates the pump motor and samples the phase again. If fuel were added into the tank since the dry-run alarm was triggered, the phase value measured will then be below the reference value. The microprocessor will clear the alarm condition and reactivate the pump. If the phase value is still greater than the reference value, the pump motor is likely still operating in air, indicating that the tank is still empty. In this case, the controller will leave the alarm active.

In addition to detecting the dry-run condition of the pump, the process of monitoring the voltage signal, current signal, and phase of the pump motor allows the controller to monitor other pump characteristics as well. Because the controller is calibrated by operating the pump in the presence of the fluid to be dispensed, all that is required to setup the controller and pump for pumping a different fluid is to recalibrate the controller in the presence of that fluid. This way, the fuel grade, for example, dispensed from a particular tank can be changed without having to replace the controller.

In addition to detecting fault conditions, a pump controller in accordance with the present invention can be used in a network with other similar pumps and pump controllers in a single tank to provide tandem or redundant operation. When used in this way, a pump can automatically request additional pumps to come online if it is operating beyond its peak performance levels. This will occur when the demand for the fuel being pumped is high. Pumps can also automatically come online if other pumps in the network are deactivated due to dry-run conditions or some other fault.

In tandem operation, a number of pumps and controllers are used in a single fuel tank, or across multiple fuel tanks dispensing the same fuel grade, to provide fuel to the dispensers. The controller of an active pump will signal another pump in the network to begin pumping either when the required flow of fuel exceeds the first pump's peak flow performance, or when the first pump is deactivated due to dry-run conditions or other malfunction.

The advantage of this network of pumps is that malfunctioning pumps will take themselves offline and request help from other pumps on the network without requiring any intervention by the operator. The remaining pumps in the network will automatically take over the task of dispensing fuel. Furthermore, this network allows the pumps to work in a masterless relationship rather than a master-slave relationship, which could fail entirely if the master pump went offline. The masterless network is also more scalable and fault-tolerant than the master-slave network.

Other purposes, uses, and features of the invention will be apparent to one skilled in the art upon review of the following.

DETAILED DESCRIPTION OF THE INVENTION

The present invention of detecting dry-run operation, low AC current, and operating the pumps in a masterless network will be described in detail with reference to the drawings.

First, the pump controller is calibrated after it is installed in a fuel tank filled with fuel. In the exemplary embodiment, the calibration is started by pressing a calibration button. Once the calibration procedure has started, no fuel can be dispensed. A microprocessor in the controller will recognize the start of the calibration procedure and will activate the pump motor. Transformer and rectifier circuits well known in the art will convert the signals from the motor power lines to signals that can be input into the digital circuitry of the microprocessor.

The analog/digital converter samples these analog power line signals and provides digital reference values for voltage levels, current, and phase difference between the voltage and current signals. The analog/digital converter then passes these sampled values to the microprocessor which will store them in memory. In other embodiments, the microprocessor performs calculations on these sampled reference values to derive reference values for testing other conditions. If the fuel in the tank is replaced with a different fuel grade or a different fuel altogether, this calibration can be repeated to determine new reference values which will overwrite the old values.

In addition to the analog/digital converter and the microprocessor, when the controller is implemented in a network with fuel dispensers and other pumps, it also includes a transceiver for sending and receiving messages to and from the network.

Figure 1:
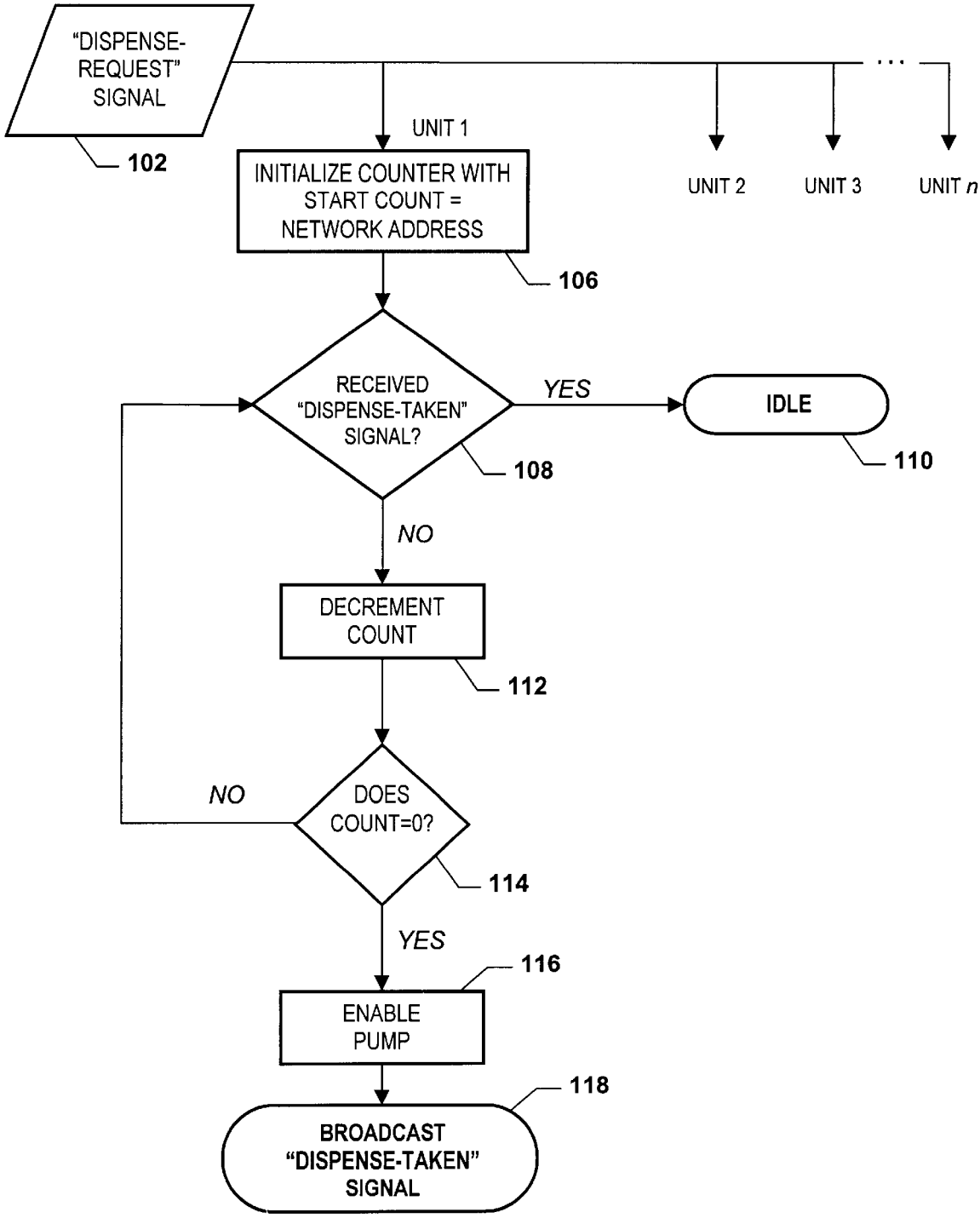
FIG. 1 is a flow diagram illustrating an embodiment of the method of operating pump controllers in a network.

Once calibration is complete, the pump and controller are ready for normal operation. In the exemplary embodiment, the pump controller is installed in a network of other pump controllers. The operation of the exemplary embodiment is illustrated, for example, in FIGS. 1 and 2.

In the network configuration, each pump controller is assigned a unique network address. In the preferred embodiment, the network address is simply a unit number that begins at 1 and counts to the total number of pumps in the network n. The communications medium of the network, in this case an ordinary network bus, is connected to each of the controllers and to the fuel dispensers.

When a dispenser is activated to provide fuel, the dispenser sends a dispense-request signal 102 to the network. Each pump controller receives the dispense-request signal and begins running a program for dispensing fuel. Once the dispense-request signal is received the microprocessor in the controller will initialize a program counter with the start count 106 equal to the network address. In this way, each controller is initialized with a different start count.

At the next stage, the program running in the controller checks to see if the controller has received a dispense-taken signal from the network 108. If the controller has received the dispense-taken signal, then a pump in the network is already providing fuel to the dispenser, and the running controller need take no action, so it ends the program and remains idle 110. If the dispense-taken signal has not been received, then no pumps are supplying fuel to the dispenser.

The program proceeds by the controller decrementing the program counter 112. Next, the program checks at 114 to see whether the program counter has reached the end value, which in the preferred embodiment is zero. Because the program counter of each controller was initialized with a different start value, one controller will always count down to zero before the others.

If the counter has not reached zero, then the program returns to check again for a dispense-taken signal 108. If the counter has reached zero, then the controller will enable the pump to provide fuel to the dispenser 116. In addition, the controller will send the dispense-taken call to the network 118. Now that this pump is preparing to provide fuel, all of the other pumps in the network will receive the dispense-taken signal and can remain idle at 110.

Figure 2:
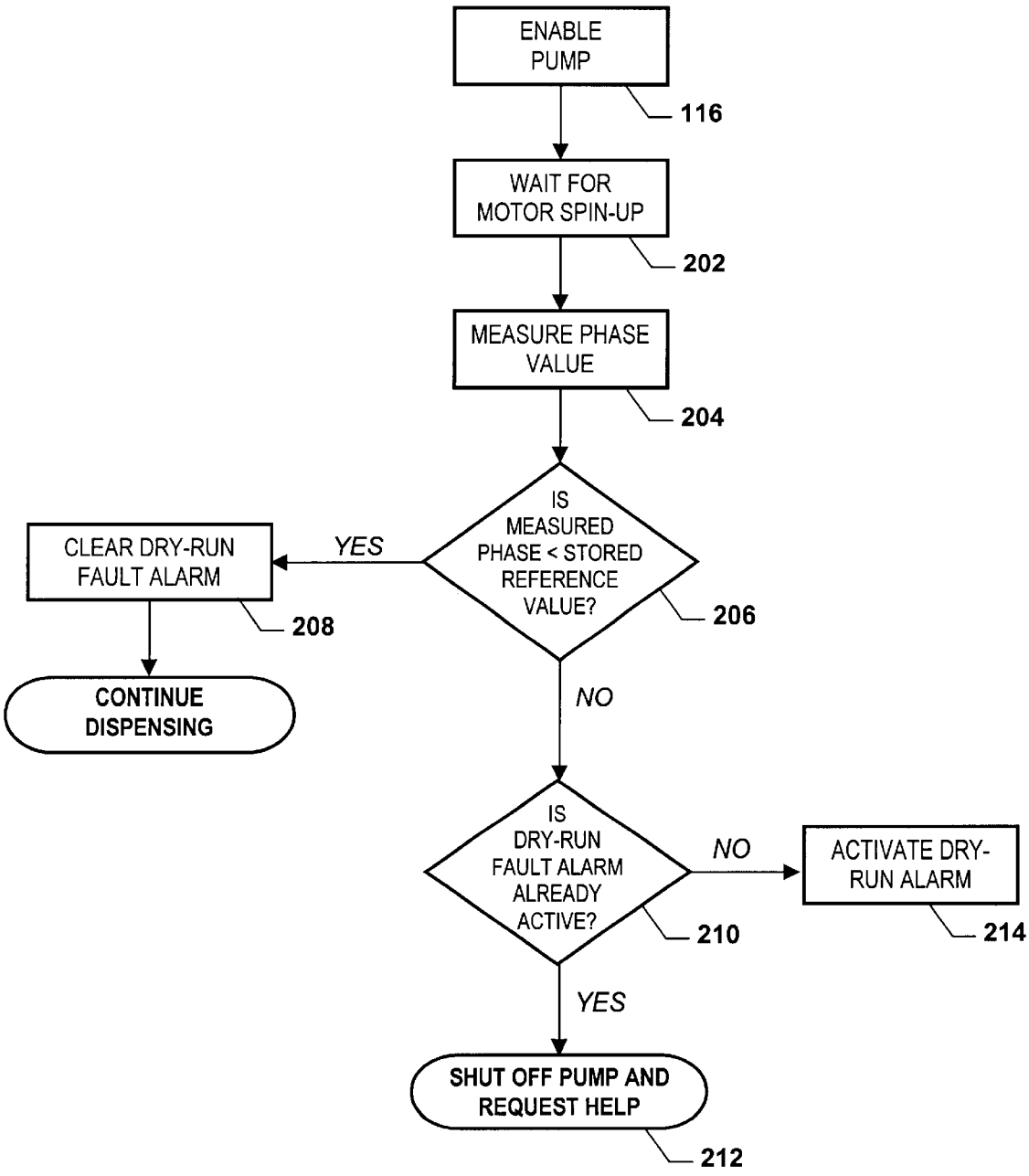
FIG. 2 is a flow diagram illustrating an embodiment of dry-run detection and automatic reset of a pump controller operating in a network.

The operation of the pump controller once it has activated the pump is continued in FIG. 2. Once the pump is enabled 116, the controller program will monitor the electrical characteristics of the pump motor in order to detect faults and signal the network to take action. FIG. 2 illustrates the process of detecting the dry-run fault condition.

After the pump is enabled 116 the controller waits a brief period of time before proceeding in order to give the pump motor time to spin-up to operating speed 202. In the preferred embodiment the wait time is 3 seconds. After the spin-up period, the electrical characteristics to be monitored are measured 204. In the case of dry-run detection, the electrical characteristic measured is the phase difference between the leading edge of the voltage signal and leading edge of the current signal of the pump motor power supply. After this phase value is measured it is checked against the reference phase value stored during calibration 206. If the measured phase is less than the reference value, then the pump is operating normally. The dry-run fault alarm is cleared 208 and the pump will continue providing fuel to the dispenser. If the phase value is greater than the reference value, then the pump is operating in the dry-run condition and must be shut-off. First, the controller checks if the dry-run fault alarm is already active 210. If the fault alarm signal is active, then the pump is kept offline and a signal is sent to the network for another pump to be activated 212. If the dry-run alarm signal is not active, then the signal is activated 214 and the pump is switched off 212.

A network of pump controllers can also provide for automatic redundancy in the event that one or more pumps in the network are disabled due to some other malfunction, or in the event that the demand for fuel to be dispensed exceeds the ability of one pump to supply it, in which case another pump should be activated in parallel to the one already pumping.

It is contemplated that numerous modifications may be made to the pump controller of the present invention without departing from the spirit and scope of the invention as defined in the following claims.

What is claimed is:

1. A method for controlling each of a plurality of submersible pump motors operating in a network of pump motors comprising:

setting a peak current level for the pump motor;

activating said pump motor;

measuring the current through said motor to obtain a measured current;

comparing said measured current to said set peak current level; and sending a signal to the network when said measured current exceeds said peak current level.

2. The method of claim 1, further comprising:

submersing a pump associated with one of the plurality of submersible pump motors in a fluid in a fluid tank;

activating the one of the plurality of pump motors;

measuring an electrical characteristic of the pump motor to obtain a measurement of the electrical characteristic; and storing said measurement as a calibration value for said electrical characteristic.

3. The method of claim 1, wherein the electrical characteristic is a phase angle between a leading edge of a pump motor power supply voltage signal and a leading edge of a pump motor power supply current signal.

4. The method of claim 1, wherein the electrical characteristic is a power factor of the pump motor.

5. The method of claim 1, wherein said measuring comprises:

sampling the electrical characteristic to obtain a digital value for the electrical characteristic.

6. A method for controlling a pump controller connected to a network of pump controllers and fluid product dispensers, comprising:

assigning each pump controller a unique network address;

receiving a dispense-call-taken signal from the network;

sending a dispense-call-taken signal to the network;

receiving a dispense-request signal from the network;

initializing a loop counter with a start value when said dispense-request signal is received; and decrementing said loop counter until the dispense-call-taken signal is received from the network or until said loop counter equals an end value.

7. The method of claim 6, further comprising:

measuring a phase difference between a leading edge of a voltage signal and a leading edge of a current signal of a motor power supply during operation of the a motor associated with one of the pump controllers to obtain a measured phase value;

comparing said measured phase value to a pre-stored dry-run phase value; and deactivating a pump associated with the one of the pump controllers and setting an alarm when said measured phase value is greater than said pre-stored dry-run phase value.

8. The method of claim 7, further comprising:

automatically resetting the alarm when said measured phase value is less than; said pre-stored dry-run phase value.

9. The method of claim 8, wherein said resetting further comprises:

momentarily restarting the pump motor; and measuring a phase difference between the leading edge of a voltage signal and a leading edge of a current signal of the motor power supply during operation of the motor to obtain a measured phase value; and comparing said measured phase value to a pre-stored dry-run phase value.

10. The method of claim 9, further comprising deactivating the alarm and restarting the pump when the measured phase value is less than said pre-stored dry-run phase value.

11. The method of claim 9, further comprising leaving the alarm activated and the pump disabled when the measured phase value is greater than the pre-stored dry-run voltage value.

12. The method of claim 6 further comprising:

activating the pump motor when the loop counter equals the end value; and sending said dispense-call-taken signal to the network when pump motor is activated.

13. The method of claim 6, further comprising:

idling when the dispense-call-taken signal is received from the network.

14. The method of claim 6, wherein said start value is the unique network address of the pump controller.

15. The method of claim 6, wherein said end value is zero.

16. Apparatus for dispensing a fluid product, comprising:

at least one fluid product tank;

at least one fluid dispenser;

at least one fluid product pump, said fluid product pump having a fluid intake and a fluid output, said fluid product pump located inside said fluid product tank, said fluid product pump submerged in the fluid contained in said fluid product tank;

each of said fluid dispensers connected to the fluid output of at least one of said fluid pumps;

each of said fluid product pumps controlled by a different pump controller; and at least one of said pump controllers having a means for detecting dry-run operation of the fluid product pump.

17. The apparatus of claim 16, further comprising:

a communications network, said communications network comprising a plurality of said pump controllers;

each of said pump controllers having a unique address in said communications network; and each of said pump controllers comprising a means for requesting assistance.

18. A pump controller network comprising:

at least one fluid product dispenser;

a plurality of pump controllers;

a communications medium;

each of said pump controllers having a unique network address;

each of said pump controllers being connected to said communications medium;

said fuel product dispenser connected to said communications medium;

a computer program, said computer program comprising a program loop;

each of said pump controllers running said computer program; and the duration of said program loop determined by the unique network address of the pump controller.

* * * * *